US006602177B2

(12) United States Patent
Muir

(10) Patent No.: US 6,602,177 B2
(45) Date of Patent: Aug. 5, 2003

(54) MACHINE FOR PRODUCING ALUMINUM FOIL SHEETS FOR HAIR COLORING

(76) Inventor: Grant Muir, 471 Thorold Road, Welland, Ontario (CA), L3C 3W7

( * ) Notice: Subject to any disclaimer, the term of this patent is extended or adjusted under 35 U.S.C. 154(b) by 37 days.

(21) Appl. No.: 09/888,553

(22) Filed: Jun. 26, 2001

(65) Prior Publication Data

US 2002/0003157 A1 Jan. 10, 2002

Related U.S. Application Data

(60) Provisional application No. 60/214,420, filed on Jun. 28, 2000.

(51) Int. Cl.[7] ..... B31F 1/10; B31F 1/08; B31F 7/00

(52) U.S. Cl. ..... 493/424; 493/434; 493/442

(58) Field of Search ..... 493/415, 424, 493/427, 434, 442, 429, 459, 464

(56) References Cited

U.S. PATENT DOCUMENTS 4,090,701 A * 5/1978 Von Hein ..... 493/427
4,375,971 A * 3/1983 Moll ..... 493/442
5,129,876 A * 7/1992 Brabant et al. ..... 493/442
5,554,094 A * 9/1996 Viens ..... 493/442
5,803,891 A * 9/1998 Haan et al. ..... 493/442
6,120,427 A * 9/2000 Haan et al. ..... 493/442
6,206,817 B1 * 3/2001 Sette et al. ..... 493/442
6,234,947 B1 * 5/2001 Michalik ..... 493/434
6,258,017 B1 * 7/2001 Singh ..... 493/424
6,312,371 B1 * 11/2001 Long ..... 493/434
6,358,192 B1 * 3/2002 Michalik ..... 493/424
6,383,124 B1 * 5/2002 St. Germain et al. ..... 493/424
6,419,616 B1 * 7/2002 Campbell ..... 493/427

* cited by examiner

*Primary Examiner*—Anthony D. Stashick

(57) ABSTRACT

A machine for cutting and folding sheets of aluminum foil dispensed from a roll. The machine comprises means for mounting a roll of aluminum foil so that aluminum foil can be advanced through the machine. Two adjacent rollers can be electrically driven to advance aluminum foil by frictional force from the roll. The machine further comprises a knife mechanism for cutting off a sheet of aluminum foil after it has passed between the rollers and means for folding an edge of a cut sheet produced by the knife mechanism. A control unit for controlling the knife mechanism ensures that the aluminum foil is cut only during predetermined intervals.

18 Claims, 13 Drawing Sheets

MACHINE FOR PRODUCING ALUMINUM FOIL SHEETS FOR HAIR COLORING

Priority is claimed from U.S. Provisional Patent Application No. 60/214,420, filed on Jun. 28, 2000.

FIELD OF THE INVENTION

This invention relates to machines for cutting and folding sheets of aluminum foil.

BACKGROUND OF THE INVENTION

Machines for dispensing a predetermined amount of material from a sheet roll of material are known in the prior art. U.S. Pat. No. 3,949,918 issued Apr. 13, 1976 discloses a heavy gauge plastic film dispenser with a motor for semi-automatic dispensing. The motor of the dispenser operates for a pre-determined time interval allowing an amount of material to be dispensed. The dispensed material is manually torn off by cut-off blade on the dispenser, which is used in the packing of meat cuts.

Using small sheets of aluminum foil in a hair coloring process is well known. U.S. Pat. No. 5,816,268 issued Oct. 6, 1998 teaches a hair highlighting method and apparatus using sheets of foil. Experts in hair coloring are familiar with how aluminum foil is used, but typically the procedure involves wrapping hair in aluminum foil. A hair coloring procedure which uses aluminum foil can be more expensive than other procedures. One cheaper method for coloring hair involves the use of a cap with holes in it.

Upwards of one hundred small sheets of aluminum foil can be required for hair coloring using the foil method. Also, in this known method the sheets need to be folded along one of the edges. Edge folding prevents bleeding of the colorant and adds edge strength to the foil. It becomes readily apparent how time consuming a manual hair coloring procedure can be if many sheets have to be cut and folded manually from a roll of aluminum foil. A machine which can automatically cut and fold aluminum foil could greatly reduce the effort required to color hair by the aluminum foil method.

SUMMARY OF THE INVENTION

According to one aspect of the invention, a machine for cutting and folding sheets of aluminum foil dispensed from a roll includes means for mounting a roll of aluminum foil so that aluminum foil can be advanced through the machine. Two adjacent rollers can be electrically driven to advance aluminum foil by frictional force from the roll. The machine further comprises means for cutting off a sheet of aluminum foil after it has passed between the rollers and means for folding an edge of a cut sheet produced by the cutting means. Means for controlling the cutting means ensures that the aluminum foil is cut only during predetermined intervals.

In an alternate embodiment the invention comprises a machine for cutting and folding sheets of aluminum foil dispensed from a roll, the machine comprising a machine for folding sheets of foil, the machine comprising;

(a) a means for controllably advancing a sheet of foil along a sheet feed direction through said machine;

(b) a means for folding an end of said sheet such that said end including a folded part;

c) a means for discharging said sheet from said folding machine such that said trailing end including a layered edge.

Preferably wherein said folding means including a folding assembly for creasing or folding an end into said folded part.

Preferably wherein said folded part is initially preferably an upstanding vertical section.

Preferably wherein said folded part is initially preferably an upstanding vertical section connected to a downwardly disposed tail section forming an inverted V shape.

Preferably said discharge means further includes a means for flattening said folded part, to form a layered edge.

Preferably wherein said further folding means includes a knockdown roller for interacting with said folded part and further folding said folded part.

Preferably wherein said knockdown roller is preferably made of a soft resilient material for engaging with a top edge of said folded part thereby further folding and knocking down said folded part.

Preferably wherein said knockdown roller is preferably made of a resilient foam.

Preferably wherein said folding assembly includes V shaped folding member and a cooperating composite blade for initially folding an end of said sheet.

Preferably wherein said folding member and cooperating composite blade forms a folded part in an end of said sheet which is preferably an inverted V shape;

In an alternate embodiment the invention comprises a machine for cutting and folding sheets of aluminum foil dispensed from a roll, the machine comprising;

(a) a means for mounting a roll of aluminum foil so that aluminum foil can be advanced through said machine.

(b) two adjacent nip rollers rotatable by a drive system to advance aluminum foil by frictional force from said roll;

(c) a knife mechanism for cutting off a sheet of aluminum foil after it has passed between said nip rollers;

(d) a folding mechanism for producing a folded part of a cut sheet produced by said knife mechanism; and (e) means for controlling and operating said knife mechanism so that the aluminum foil is cut only during predetermined intervals.

Preferably wherein said folding mechanism including a folding assembly for creasing or folding an edge into said folded part.

Preferably wherein said folded part initially is preferably an upstanding vertical section.

Preferably wherein said folded part initially is preferably an upstanding vertical section connected to a downwardly disposed tail section forming an inverted V shape.

In an alternate embodiment the invention comprises a method of folding sheets of foil, the method comprising the steps of:

a) advancing a sheet of foil through a folding machine;

b) folding a trailing end of said sheet such that said trailing edge including a folded part; and c) discharging said sheet with a layered edge from said folding machine.

Preferably wherein said folded part initially is preferably an upstanding vertical section.

Preferably wherein said folded part initially is preferably an upstanding vertical section connected to a downwardly disposed tail section forming an inverted V shape.

Preferably further including the step after step b) of b) further folding said folded part.

Preferably wherein said folding machine including a knockdown roller for interacting with said folded part and further folding said folded part.

Preferably wherein said knockdown roller is preferably made of a soft resilient material for engaging with a top edge of said folded part thereby further folding and knocking down said folded part.

DETAILED DESCRIPTION OF THE PREFERRED EMBODIMENTS

Figure 1:
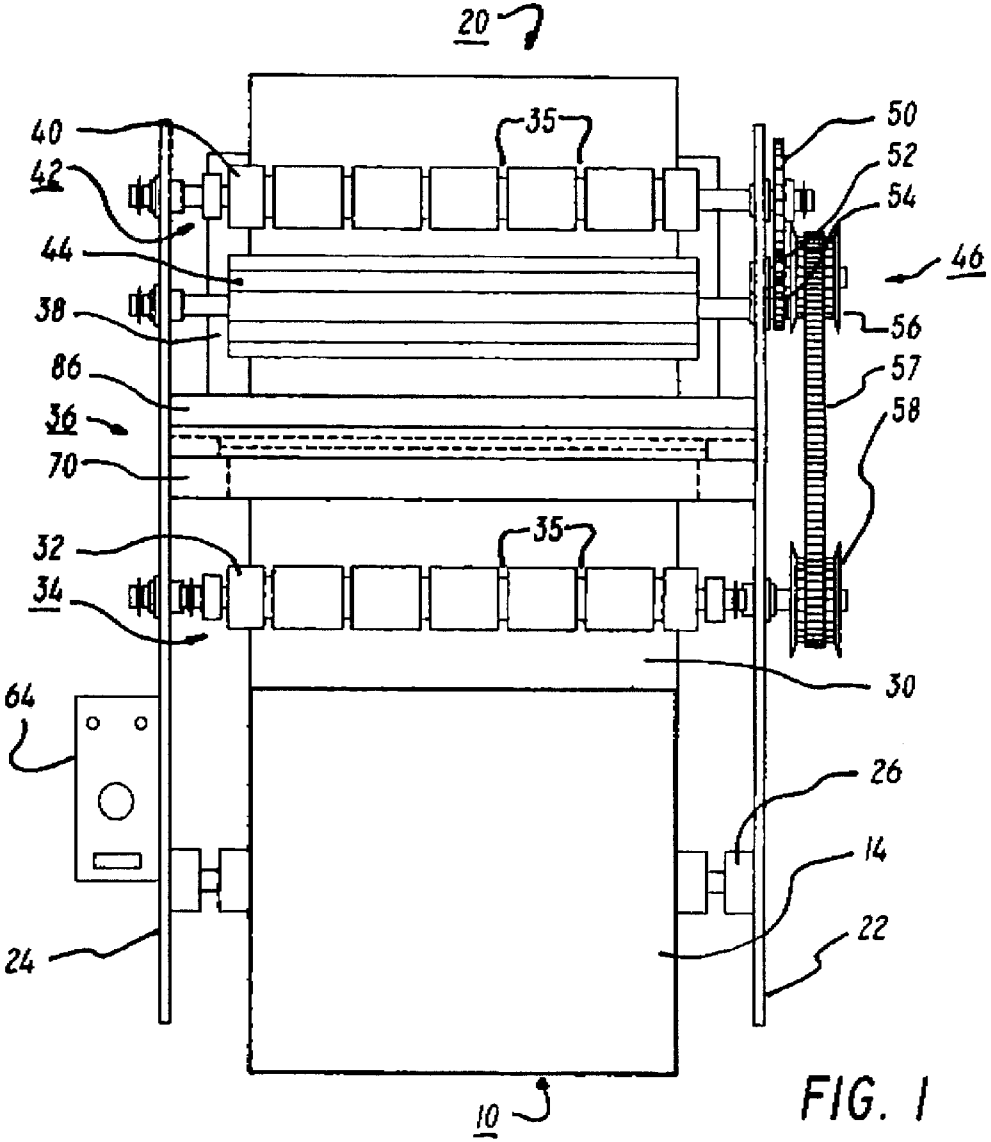
FIG. 1 is a top view of the machine of the present invention.
Figure 2:
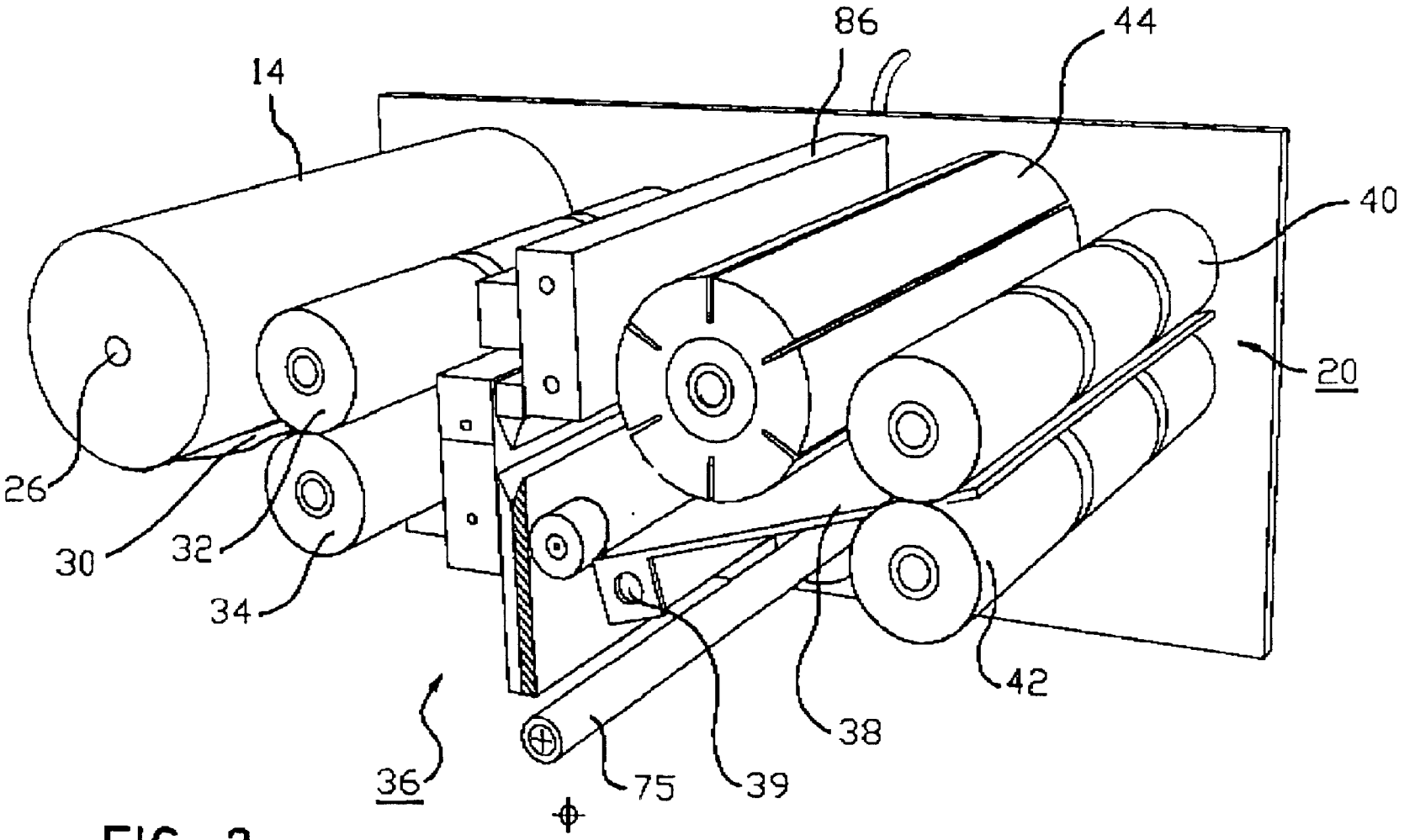
FIG. 2 is an isometric view illustrating the moving parts inside the machine.

In FIG. 1, roll 14 is rotatably mounted in the machine 10 on roll mount 26. This roll 14 preferably has a width of 5 inches, being the width used for hair coloring. Typically a 5 lb. Roll of foil is suitable for this machine. The roll mount 26 is attached at its respective ends to the sidewalls 22 and 24, and the mount includes a spring loaded pinch mechanism which engages two roll apertures centrally located on the ends of the roll. Referring to FIG. 2, foil web or sheet 30 should unwind smoothly and evenly with minimal constant tension. The sheet 30 is advanced from the roll 14 through two rear nip rollers 32 and 34 The nip rollers frictionally engage and position the sheet so that it advances properly into a knife cutting and folding assembly 36. Ensuring contact between the roller 32 and the sheet 30, as well as contact between the sheet and the roller 34 requires that the two rollers be positioned closely together. The preferred nip rollers 32, 34 have a series of spaced apart grooves 35 formed therein.

FIG. 1 illustrates a machine 10 used for producing small aluminum foil sheets for hair coloring. The machine 10 accepts a roll of foil 14, advances foil from the roll trough the machine and chops foil dispensed from the roll into small sheets such as sheet 16 illustrated in FIG. 8. The small sheets exit the cutting device at a dispenser end 20. Machine parts including several rollers are mourned between two machine frame sidewalls 22 and 24. The machine parts which are rotatable are of course rotatably mounted on suitable shafts or stub shafts that extend through round holes in the sidewalls. The sidewalls 22 and 24 are made of steel or some other rigid metal. The sidewalls are also preferably rectangular in shape so that the machine 10 has a box like appearance when assembled. In a preferred embodiment, the box shaped machine 10 is relatively portable. The machine is preferably constructed so that the machine is stable on a flat surface without securing means, even during its operation. The preferred machine also has a cover (not shown) extending over the top.

The web is then cut and folded in a process described hereinafter and illustrated in FIGS. 3 through 6. The cut sheet 16 will advance out of the assembly 36 and onto a stationary knock-down table 38. Shaft support 39 keeps the table relatively fixed in place. The table 38 is inclined to properly direct the sheet 16 so that it will advance through two front nip rollers 40 and 42.

Figure 3:
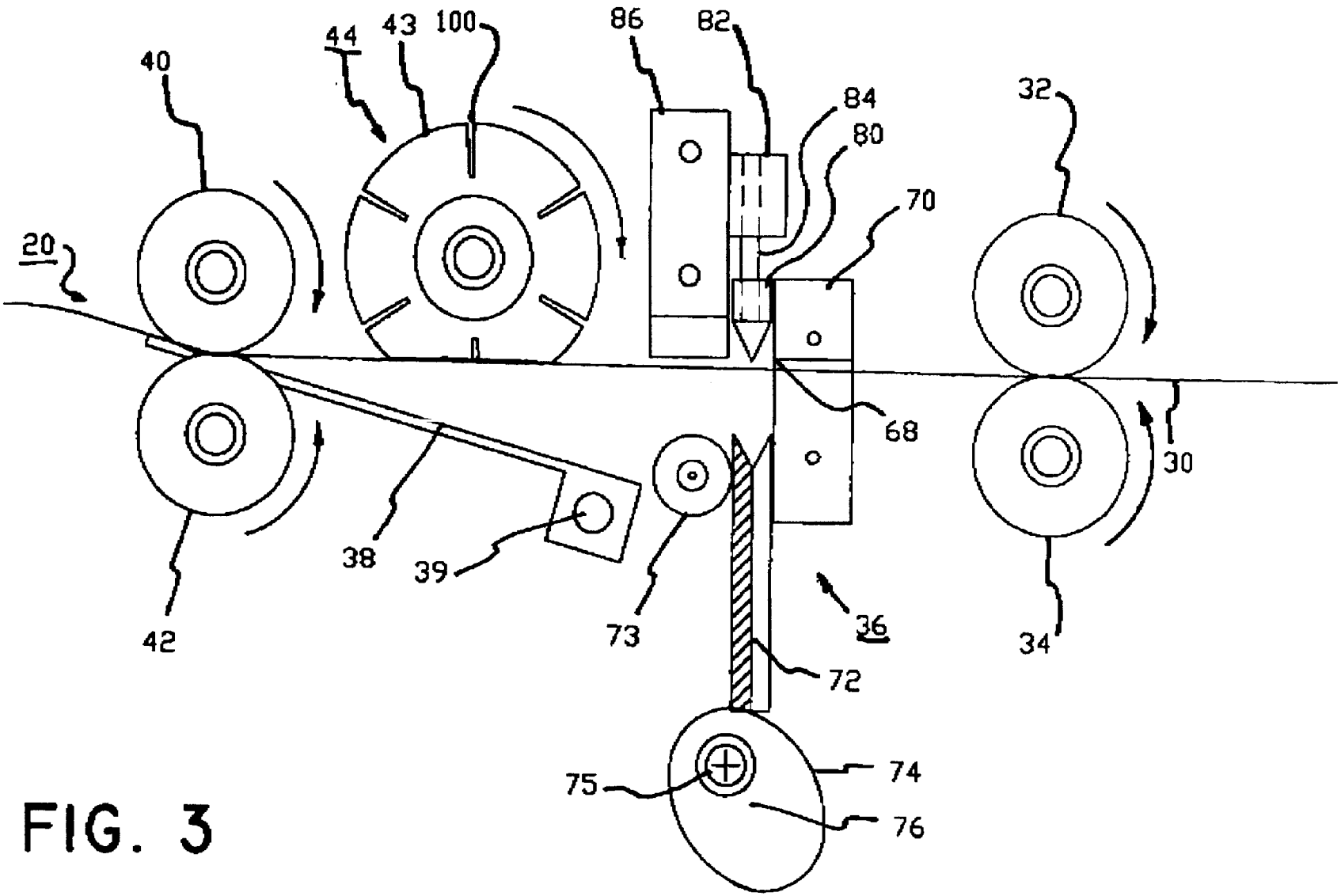
FIG. 3 is a side view of cutting knife and folding apparatus used in the present invention, this view showing the foil strip prior to cutting.

The nip rollers 40 and 42 can be constructed in a manner similar to the rollers 32 and 34. Although all rollers rotate together, nip rollers 40 and 42 rotate slightly faster than the rear nip rollers 32 and 34. This speed difference allows the leading edge of foil to stay ahead of the lagging web leading edge as they travel through the machine web path and out. It also keeps the web taught between front and back rollers before cutting as illustrated in FIG. 3. The rollers 32, 34, 40 and 42 are spring tensioned in order for them to apply some pressure to the foil surface. Reference is made to U.S. Pat. No. 3,949,918 which teaches rollers similar in principle to these i.e. pairing two rollers and passing a sheet of material between them.

As the sheet 16 advances out of the assembly 36 (FIG. 5), it also passes under a knock-down roller 44. A preferred diameter for the roller 44 is 1.25". The roller has a transverse, centrally extending bore which could be 0.75" in diameter. Protruding members 43 which are evenly spaced apart by transverse grooves 100 should preferably be made of open cell foam which is a soft material and which allows the members 43 to be easily deformed. In a preferred embodiment, the roller 44 including its members 43 is made of a single piece of foam.

Figure 5:
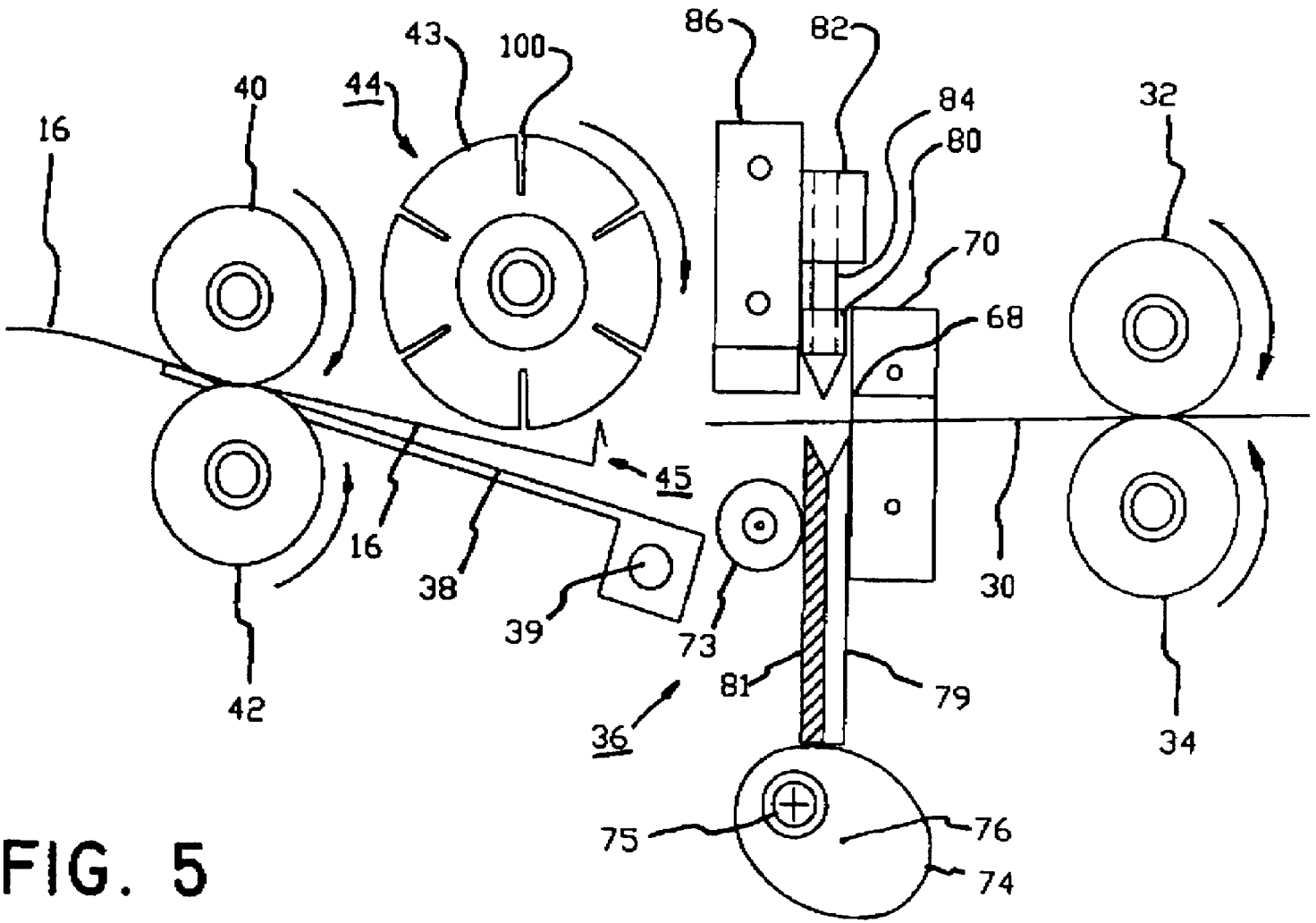
FIG. 5 is yet another side view of the cutting blade and folding apparatus, this view showing the cut-off sheet being pulled forwards to a knock-down roller and having a creased lagging edge.
Figure 6:
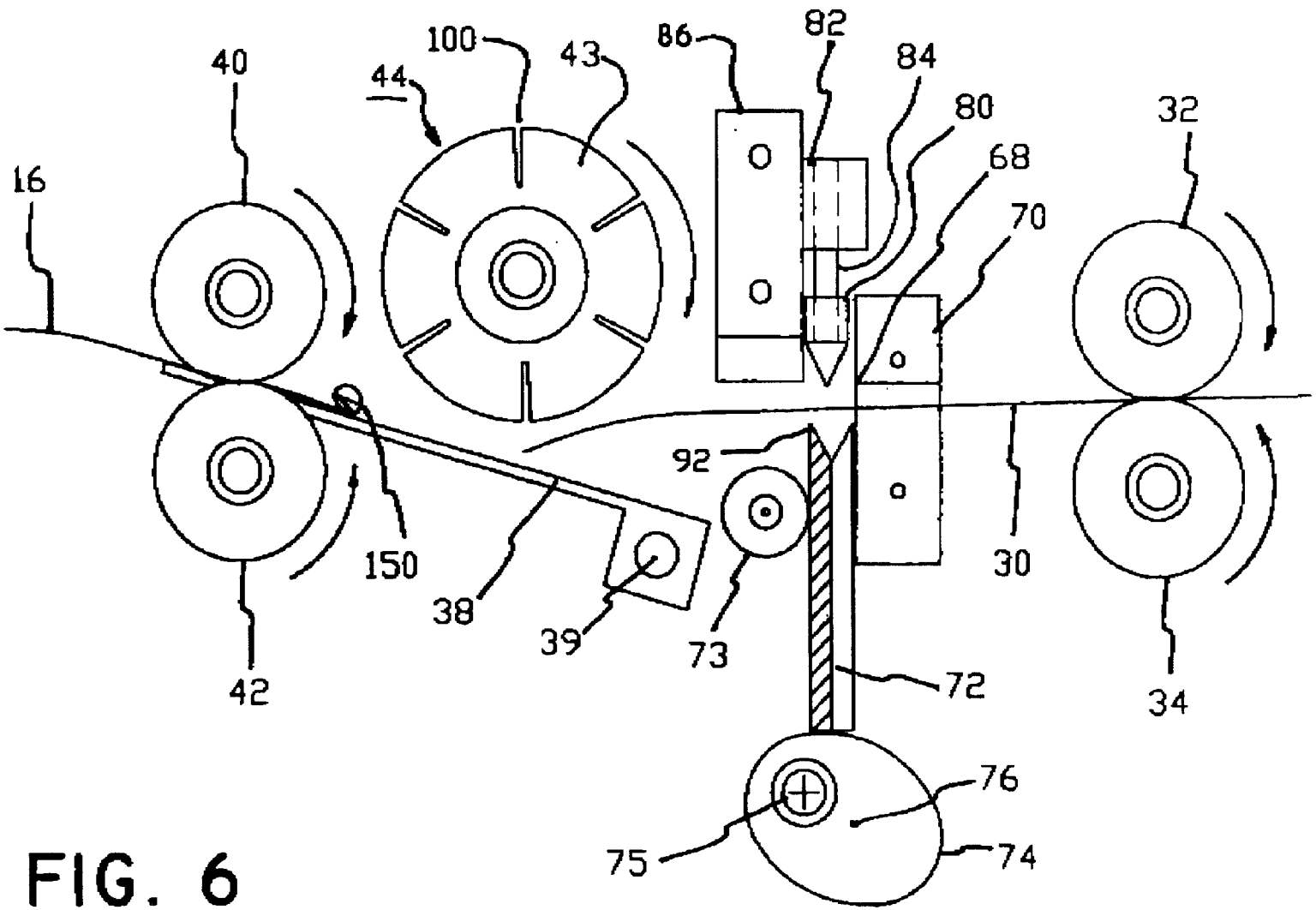
FIG. 6 is still another side view of the cutting knife and folding apparatus, this view showing the cut-off sheet after it has been folded by the knock-down roller.

The roller 44 is positioned approximately an eighth of an inch above the table 38 to work effectively. As illustrated in FIG. 5, folded part 45 of the sheet 16, has an inverted V shape and will come in contact with the surface of the roller 44. The folded part 45 interacts with the roller 44. In particular, the soft open cell foam or one of the grooves 100 catches the part 45. The folded part is rolled forward by the knock-down roller which is rotating at a faster rate than the speed at which the web sheet is advancing. The interaction further folds the sheet 16 as FIG. 6 illustrates. Now past the roller 44, the sheet 16 has a folded edge 150 which can be folded two or more times. The folded edge 150 will be flattened when it passes through the rollers 40 and 42.

In FIG. 1, motion control assembly 46 controls the advancement of foil in the machine 10. The assembly 46 includes a number of spur gears 50, 52 and 54 and timing pulleys 56 and 58. A timing belt 57 passes over the pulleys ensuring that the rollers rotate together. The front rollers 40, 42 preferably rotate slightly faster than the rear nip rollers allowing the leading sheet of foil to stay ahead of the lagging web leading edge. In one preferred version of the machine, the spur gears provide a 3:1 turning in ratio between the front rollers 40, 42 and the knockdown roller 44. One skilled in the art will appreciate that there are various means from controlling and synchronizing rotational motion, and that thc assembly 46 could be modified in various obvious ways which would still achieve the disclosed motion requirements.

Advancement of foil through the machine 10 is controlled by a standard electric tuning circuit which is not illustrated. In one version of the machine, an Electromatic Timing Relay (No. 5110166-120) was used. The electric circuit operates an electric motor 64, the motor 64 in turn rotating the rollers 32 and 34. The motor 64 can be rigidly mounted on the sidewall 24. Jam detectors of known construction can be provided in the machine to stop advancement in the case of a foil jam. There is also a motor for the operation of the knife cutting and folding assembly 36. The two motors preferably do not operate simultaneously. Rather a repeated cycle exists in the machine 10, including a foil advancing period and a shearing period. Although not illustrated, it will be appreciated by one skilled in the art that there is a suitably programmed microprocessor (which can be a standard microprocessor) for controlling operation of the machine. The timing circuit is energized by turning on a main electrical power switch (not shown).

FIGS. 3 through 6 illustrate stages during which the sheet 30 is cut and folded. The sheet 30 is cut at a point indicated at 68 (FIG. 3) on the rear side of blade housing 70. Specifically the sheet is cut when composite blade 72 rises past the cutting point 68. Two oval cams 74 (only one being in view in FIG. 3) cyclically raise and lower the blade 72. Any other suitable means to raise and lower composite blade 72 can be utilized. Roller 73 guides the blade through its vertical motion. Cam shaft 75 is offset from a central axis 76 of the cams extending perpendicular to the plan of view. In the illustrated embodiment, the cams 74 rotates in a counterclockwise direction. In another embodiment of the machine, the action of lifting and lowering the blade would be achieved by electromagnetic solenoid use. One skilled in the art and familiar with electromagnetic solenoids will appreciate how this minor modification can be made.

Note that the preferred blade 72 is a two part composite blade with one part 79 preferably being made of steel (for cutting purposes) and the other part 81 being made of a non galling material such as ultrahigh molecular weight (UHMW) plastic material or brass or other suitable material. The cams 74 can also be made of UHMW plastic or other material.

Figure 4:
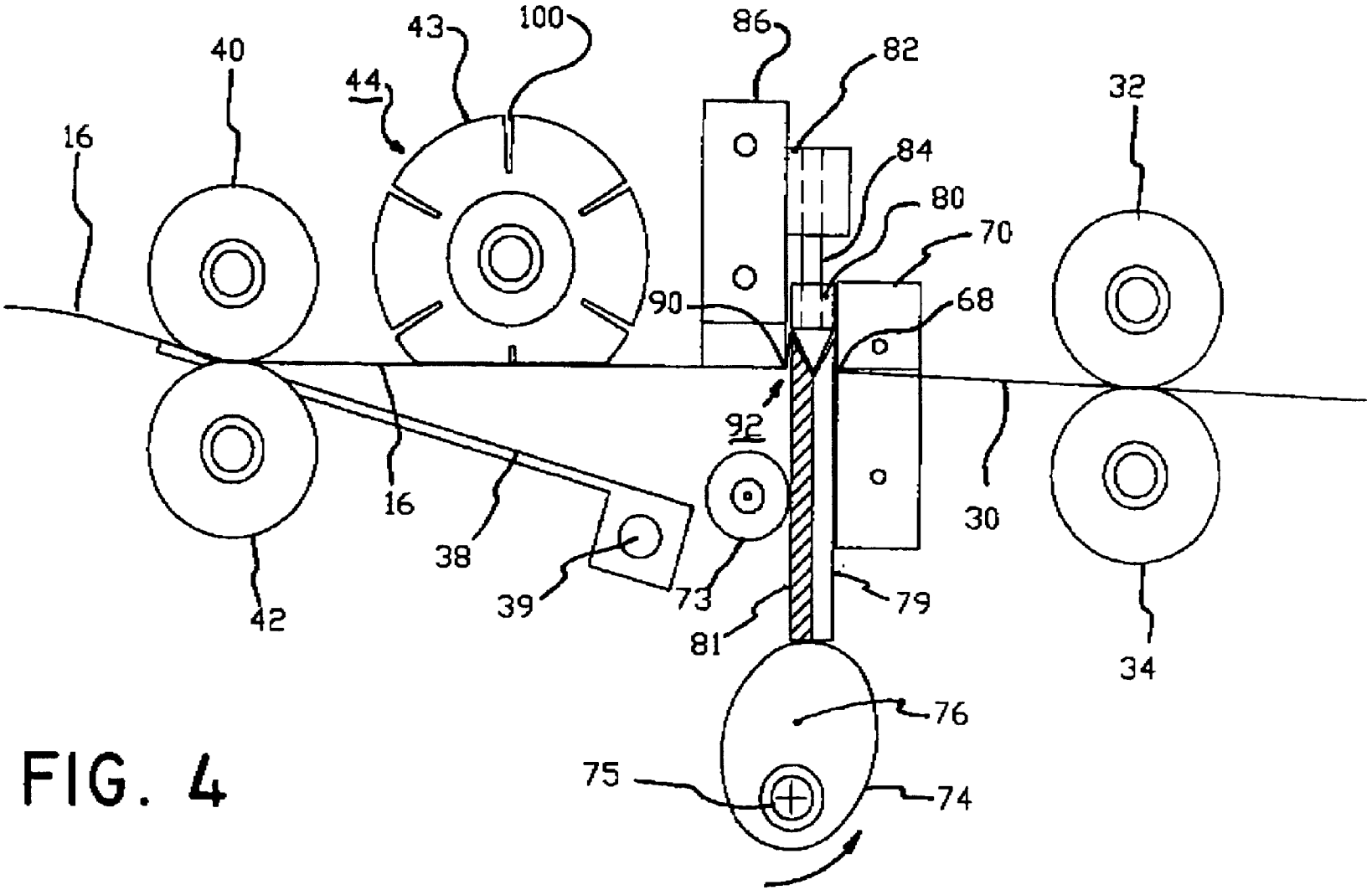
FIG. 4 is another side view of the cutting blade and folding apparatus, this view showing the foil strip being cut and folded and showing the blade at top of its stroke.
Figure 11:
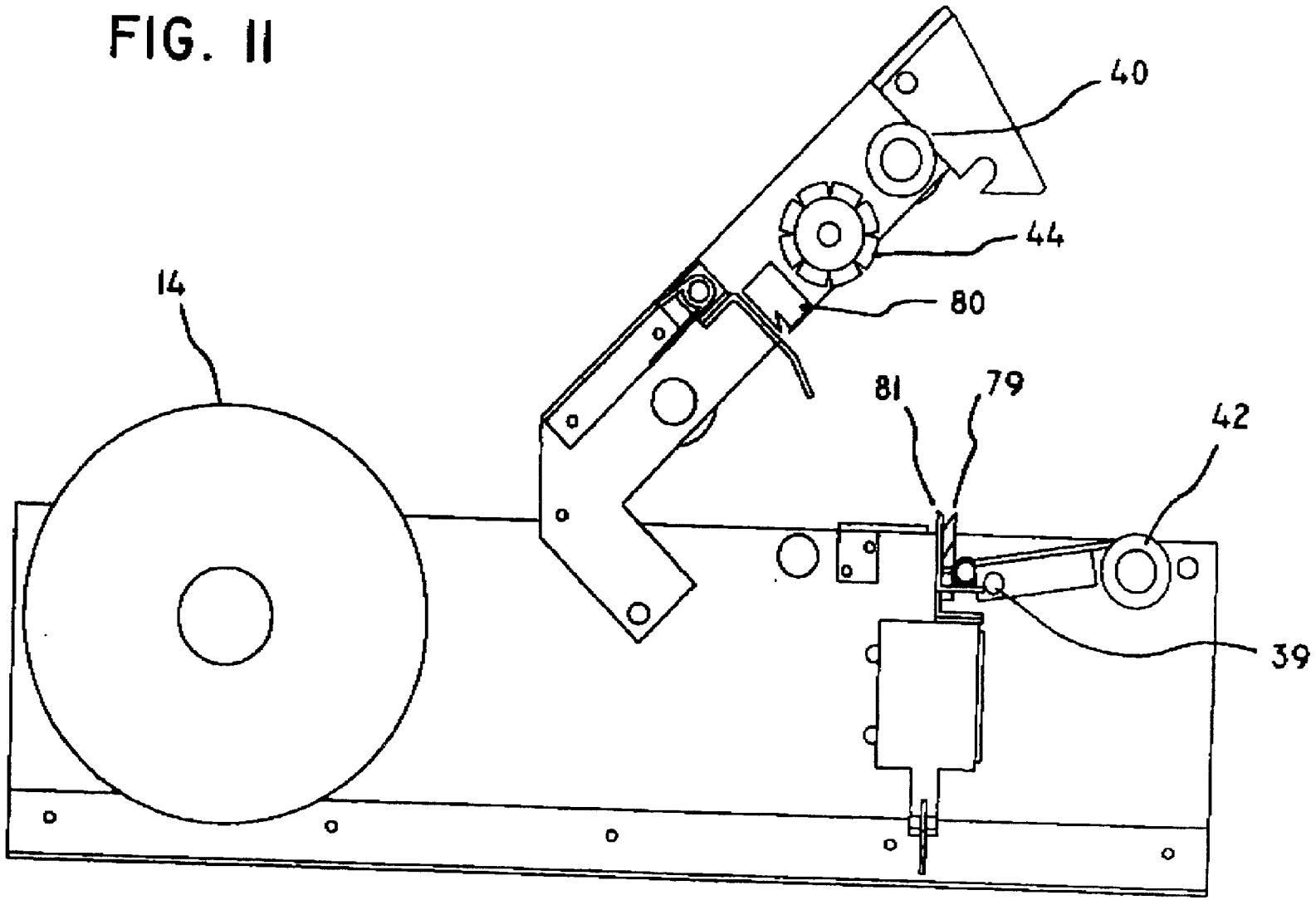
FIG. 11 is an alternate embodiment and a side view of cutting knife and folding apparatus used in the present invention, this view showing the foil strip prior to cutting.

After the aluminum foil is cut, the folding process proceeds. A stationary folding member 80 is attached to a holding bracket 82 by a shaft 84. As an alternative to the illustrated shaft 84, the folding member 80 and the shaft could be a single member as shown in FIG. 11. The bracket 82 is attached to house 86. The pointed shape of member 80 facilitates the folding process. As illustrated in FIG. 4, folding of the aluminum foil can occur at an edge 90 and at composite blade edge 92. The edge 90 is designed to create an approximately 90° fold as illustrated. The angle for the fold created by the edge 92 is acute (about 30°).

The composite blade is lowered, and the cut sheet as well as the sheet 30 are advanced as illustrated in FIG. 5. When the blade is lowered towards its normal rest position, it engages a micro switch that indicates when the blade has reached the rest position and signalling to the microprocessor to shut off power to the knife motor. The blade motion is then stopped. At this time also the microprocessor engages power to the roller motor. The folding member is opened at a predetermined time as explained below. As the cut sheet is advanced, the crease if folded over by the knockdown roller as it passes under it. The cut sheet is pressed by the nip rollers 40 and 42 as it advances out through a discharge opening.

One skilled in the art will appreciate that it would be possible to design the machine so that folding step is omitted. This would be achieved by not having the blade come in close proximity to the folding member as illustrated in FIG. 4. The machine can also be designed with a lever allowing two modes of operation. In one mode the cut sheet would be folded, and in the other the cut sheet would not be folded. Accordingly, this optional feature is intended to fall within the scope of the invention.

Figure 7C:
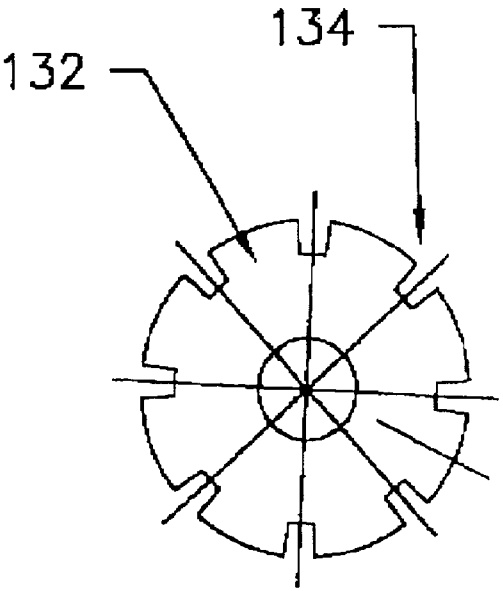
FIGS. 7 *a*) through *c*) are cross sectional view of alternative embodiments for the knock-down roller used in the present invention.
Figure 7B:
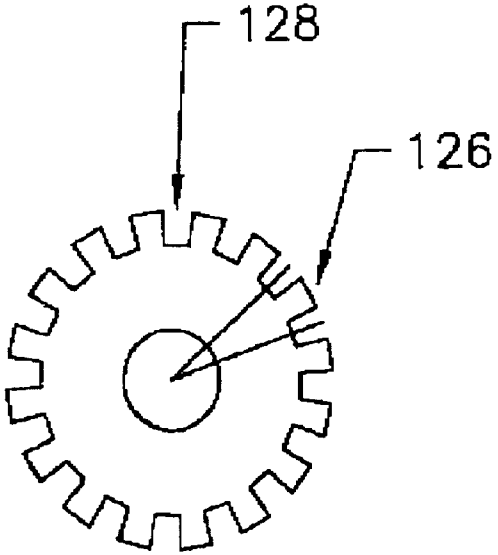
Figure 7A:
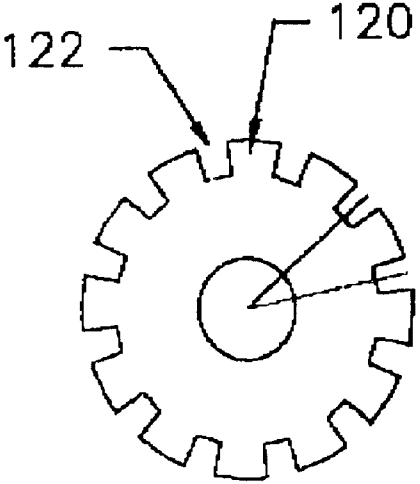

FIGS. 7(*a*) through (*c*) illustrates alternative embodiments for the knockdown roller 44. The transverse grooves in these embodiments are less deep than the transverse grooves 100. Roller 120 has twelve transverse grooves 122. Circumferential spacing between groove centers is 0.324". Rollers 126 and 132 have sixteen and eight transverse grooves 128 and 134 respectively. The circumferential spacing for the grooves 128 and 134 are 0.245" and 0.36". Again only the protruding members can be foam, or the entire roll can be a single foam piece.

Figure 8:
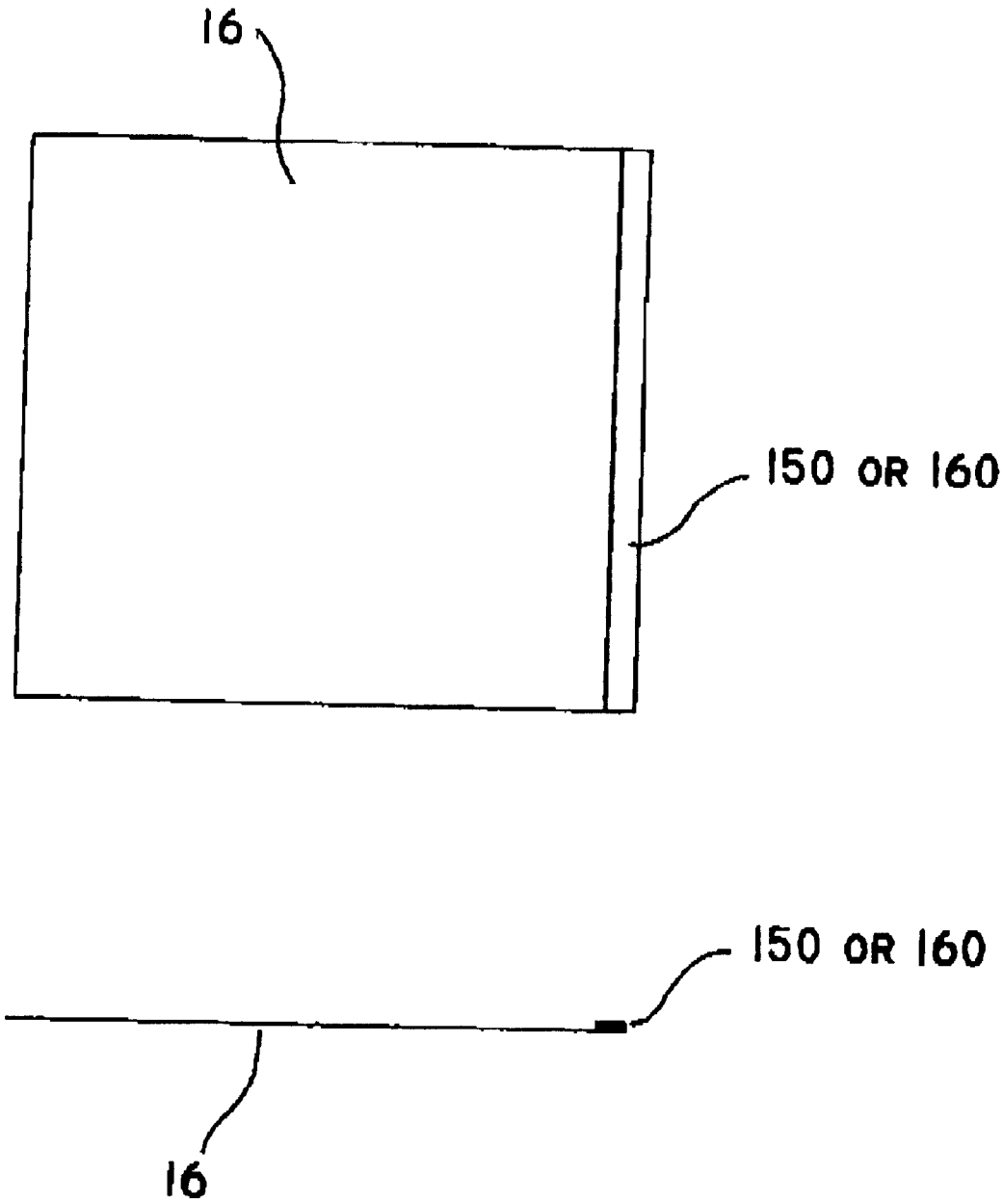
FIG. 8 is a plan and cross-sectional view of a small aluminum folded sheet produced by the machine, of the invention.
Figure 9:
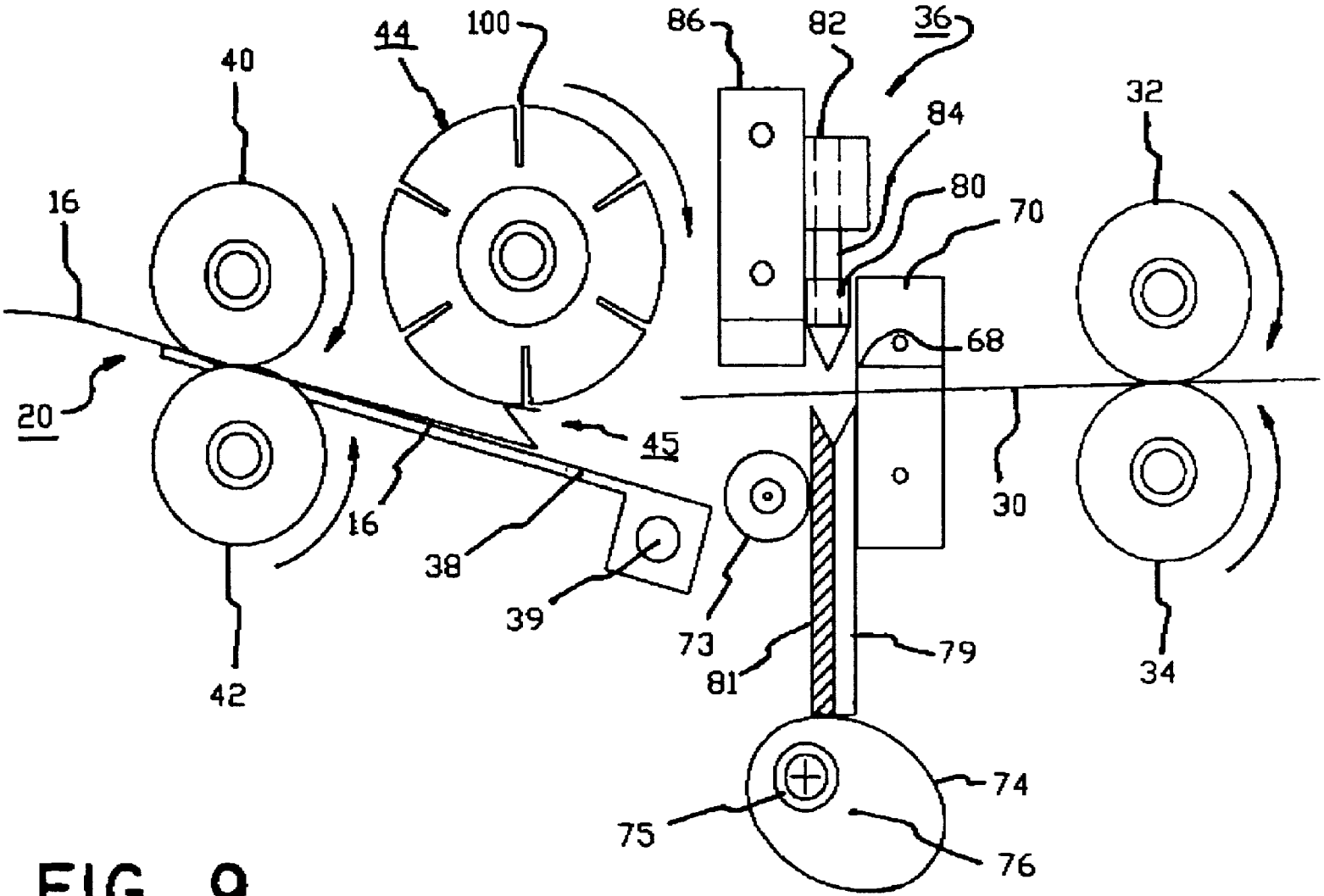
FIG. 9 is still another side view of the cutting knife and folding apparatus, this view showing the cut-off sheet after it has been folded by the knock-down roller.
Figure 10:
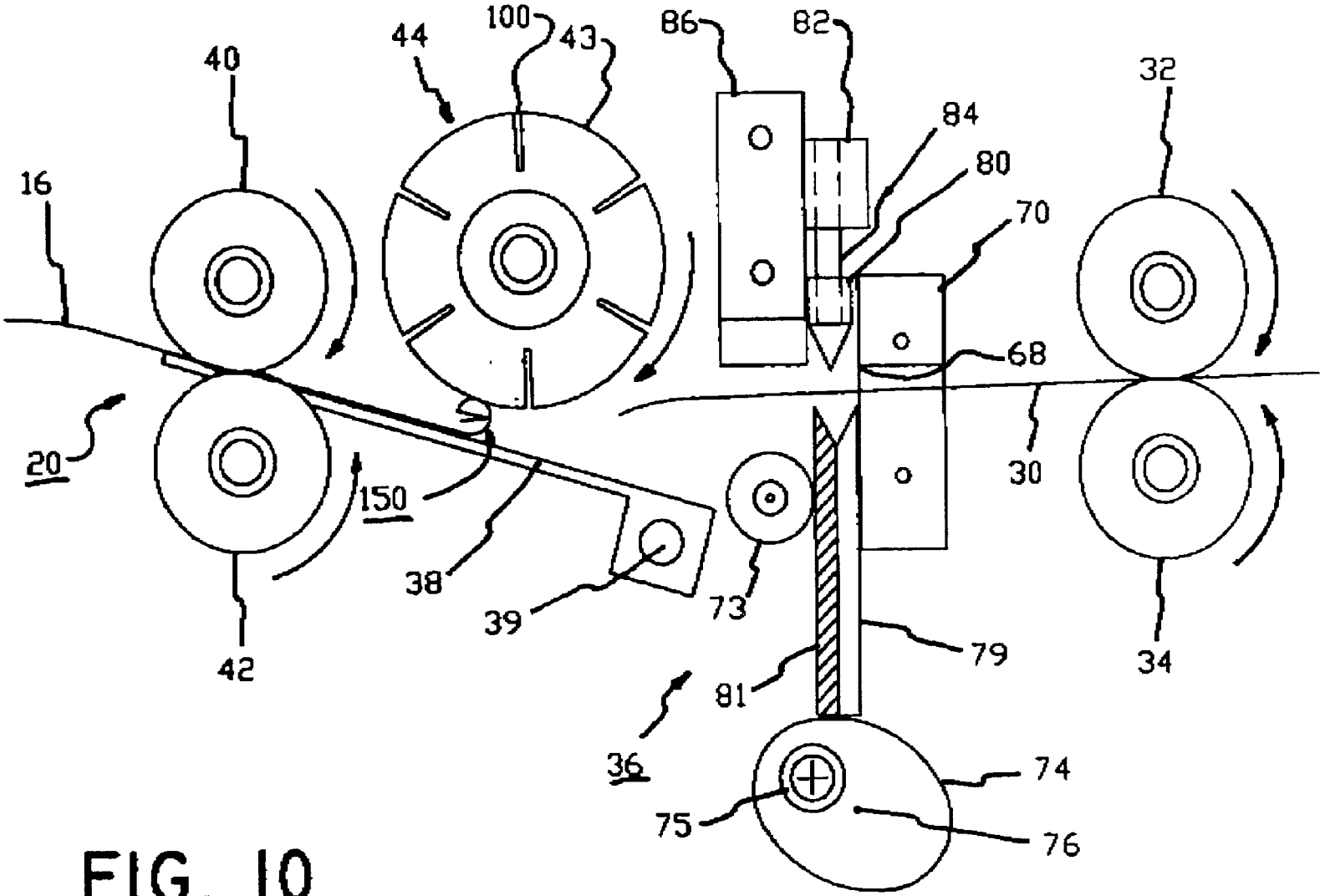
FIG. 10 is still another side view of the cutting knife and folding apparatus, this view showing the cut-off sheet after it has been folded by the knock-down roller.

FIG. 8 illustrates the small aluminum foil sheet 16 produced by the machine. The length of this sheet will vary; however the sheet width should be about 5". The layered edge 150 is preferably about three layers of aluminum foil. The dimensions of the edge 150 are about 5" by ⅛". The sheet length can be controlled by adjusting the cycle so that the sheet advances for a longer or shorter period of time. It will be appreciated that the sheet 16 will be longer if this period of time is longer.

In one version of the machine, the upper moving components are mounted on a separate pivoting frame so that these components can readily be raised from their working position in order to feed the aluminum foil to the front nip rollers 40, 42. Thus the top front and back rollers, the knockdown roller, the blade housing and fold guide are mounted on this upwardly pivoting frame. The operator can then grasp the leading edge of the foil and pull it to a point just past the front nip rollers. After ensuring that the web is centered, the upper frame can be closed to a spring locked position and the machine is ready to operate by pushing the start switch.

Figure 12:
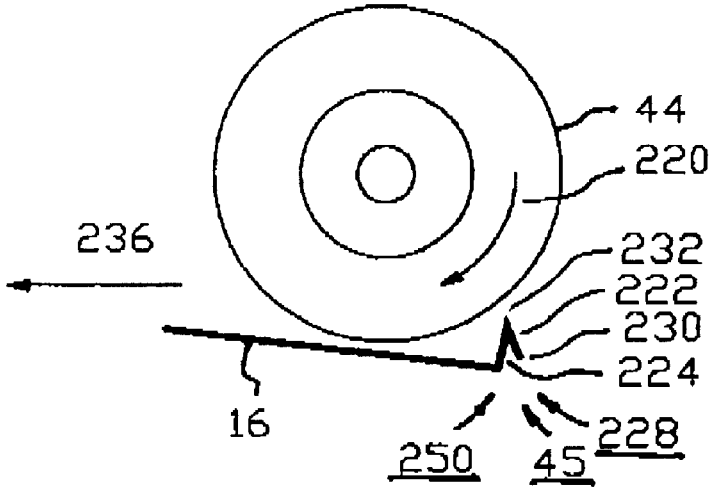
FIG. 12 is a schematic cross-sectional view of a cut sheet passing under a knockdown roller.

Referring now specifically to FIGS. 12 through 17 inclusive, which shows schematically how a cut sheet 16 interacts schematically with knockdown roller 44. In other words, we are showing schematically how folded part 45 of cut sheet 16 interacts with knockdown roller 44. FIG. 12 roughly corresponds with the position shown in earlier FIG. 5 of cut sheet 16.

A trailing end 250 of cut sheet 16 has been folded by folding assembly 36 leaving an upstanding folded part 45 in trailing end 250 of cut sheet 16.

Folded part 45 preferably is an inverted V shaped section 228 and includes the following major portions, namely in an upstanding vertical section 224 which is folded at top edge 232 and connected to a downwardly disposed tail section 222 which ends at tail end 230.

More specifically and to the best of the inventors knowledge, although it is not totally certain how folded part 45 interacts with knockdown roller 44, by stopping the machine at various points of the cut sheet 16 interacting with knockdown roller 44, FIGS. 12 through 17 illustrate, how folded part 45 interacts with knockdown roller 44.

One will note that the cut sheet 16 is fed along a sheet feed direction 236 as indicated by the arrow in FIG. 12. One will also note that knockdown roller 44 is rotating in rotation direction 220 and thereby as cut sheet 16 is fed into rotating knockdown roller 44, the soft foam 226 roller of knockdown roller 44 will interact with top edge 232 of folded part 45.

Figure 13:
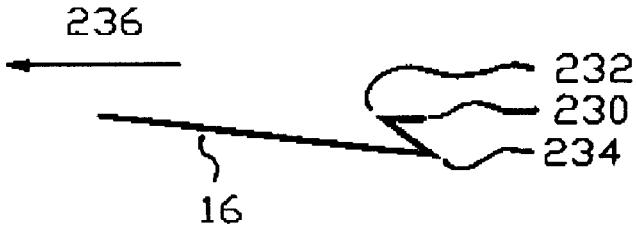
FIG. 13 is a schematic cross-sectional view of the cut sheet as it is advancing through a knockdown roller.

When top edge 232 impinges onto the outer diameter of knockdown roller 44, the soft foam 226 engages a top edge 232 of the upstanding vertical section 224 of the folded part 45. By engaging with top edge 232 of the folded part 45, it would continue to fold, folded part 45 about bottom edge 234 as shown in FIG. 13.

Figure 14:
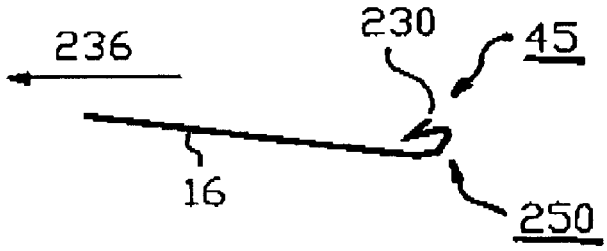
FIG. 14 is a schematic cross-sectional view of a cut sheet passing under a knockdown roller, with folded part knocked down.

As cut sheet 16 is further fed in sheet feed direction 236 into knockdown roller 44, it would eventually completely fold the vertical section 224 and the tail section 222 onto itself and onto the cut sheet 16 producing a layered edge 150 as shown in FIG. 14.

The finished product has a layered edge 150 once the sheet feed exits through nip rollers 40 and 42. Layered edge 150 is three layers thick as shown in FIG. 15.

Figure 16:
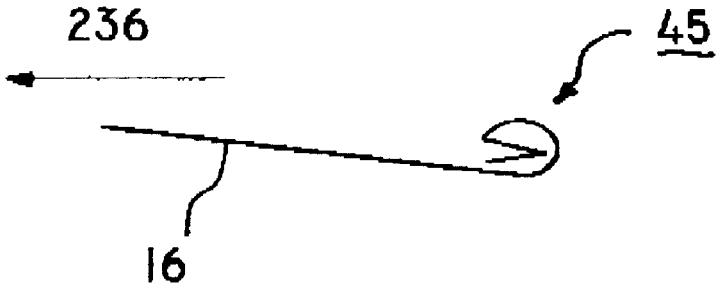
FIG. 16 is a schematic cross-sectional view of cut sheet further advancing through knockdown roller wherein folded part is further folded.
Figure 17:
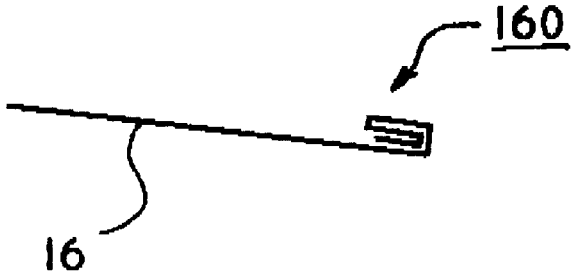
FIG. 17 is a schematic cross-section view of cut sheet showing folded part of sheet being further folded by nip rollers into a further layered edge.

Preferably, as shown in FIG. 16 if the conditions of knockdown roller 44 and the spacing and the rate of rotation is adjusted accordingly, knockdown roller 44 will again interact with tail end 230 of tail sections 222 when in the knockdown position 150 shown in FIG. 14. This will further rotate and fold, folded part 45 as shown in FIG. 16 until one obtains a layered edge 160 as shown in FIG. 17. Layered edge 160 is obtained by passing knockdown folded part shown in FIG. 16 through the front nip rollers 40 and 42.

Figure 15:
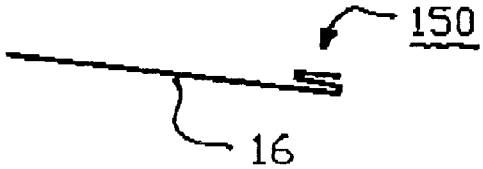
FIG. 15 is a schematic cross-sectional view of the cut sheet shown in FIG. 14 after it has passed through nip rollers producing a layered edge.

One skilled in the art will see that there are three layers in layered edge 150 as shown in FIG. 15 and that there are a total of 4 layers in layered edge 160 shown in FIG. 17.

Furthermore, through trial and error it has been found out that it is not absolutely necessary to have a tail section 222, however preferably tail section 222 is roughly half the length of vertical section 224, in order to obtain the best results. Furthermore, there is no necessity to have a certain number of folds or layers within layered edge 150 or layered edge 160. When the machine is run without a tail section 222, in other words when the folded part 45 only consists of a vertical section 224, it is possible to have only a two layered, layered edge not shown in the diagrams.

Preferably, however a four layered, layered edge 160 as shown in FIG. 17 is produced, thereby providing for a strong layered edge which is best suited for the purpose of cut sheets 16.

Once folded part 45 is formed as shown in FIG. 16, cut sheet 16 is further fed through nip rollers 42 and 40 which can completely flatten out layer edge 160, thereby producing the layered edge as depicted in FIGS. 8 and 17.

Furthermore, it has been determined that grooves 100 in knockdown roller 44 are not necessary and that a one piece knockdown roller 44 made of a soft resilient foam material (such as opened celled foam) will produce the necessary results for obtaining a layered edge 150 or layered edge 160.

It will be appreciated by those skilled in the arts that various modifications and changes can be made to the machine of this invention without departing from the spirit and scope of this invention.

I claim:

1. A machine for folding sheets of foil, the machine comprising;

a) a means for controllably advancing a sheet of foil along a sheet feed direction through said machine;

b) a means for folding a trailing end of said sheet such that said trailing end including a folded part and the other end left unfolded;

c) a stationary knock down table for receiving said sheet of foil thereon;

d) a knockdown roller for further folding said folded part against said knock down table, said roller made of soft resilient material for engaging with a top edge of said folded part thereby further folding and knocking down said folded part; and e) a means for discharging said sheet from said folding machine such that said trailing end including a layered edge and said leading edge remaining unfolded.

2. The machine claimed in claim 1 wherein said folded part is initially preferably an upstanding vertical section.

3. The machine claimed in claim 1 wherein said folded part is initially preferably an upstanding vertical section connected to a downwardly disposed tail section forming an inverted V shape.

4. The machine claimed in claim 1 wherein said discharge means further includes a means for flattening said folded part, to form a layered edge.

5. The machine claimed in claim 1 wherein said knock down roller folding said folded part into a three layered tailing edge.

6. The machine claimed in claim 1 wherein said knockdown roller folding said folded part into a four layered trailing edge.

7. The machine claimed in claim 1 wherein said knockdown roller is preferably made of a resilient foam.

8. The machine claimed in claim 1 wherein said folding means including a folding assembly for creasing or folding an end into said folded part.

9. The machine claimed in claim 2 wherein said folding assembly includes V shaped folding member and a cooperating composite blade for initially folding an end of said sheet.

10. The machine claimed in claim 9 wherein said folding member and cooperating composite blade forms a folded part in an end of said sheet which is preferably an inverted V shape.

11. The machine claimed in claim 9 wherein said composite blade including one part being a hard potion and the other part made of a non galling material.

12. The machine claimed in claim 11 wherein said composite blade including one part made of steel and the other part made of brass.

13. The machine claimed in claim 11 wherein said composite blade including one part made of steel and the other part made of ultra high molecular weight plastic.

14. A method of folding sheets of foil, the method comprising the steps of:

a) advancing a sheet of foil through a folding machine;

b) folding a trailing end of said sheet such that said trailing edge including a folded part;

c) receiving said sheet on a stationary knock down table;

d) further folding said folded part against said knock down table with a knockdown roller, said roller made of soft resilient material for engaging with a top edge of said folded part thereby further folding and knocking down said folded part; and e) discharging said sheet with a trailing layered edge from said folding machine wherein said other edge remaining unfolded.

15. The method of folding sheets of foil claimed in claim 14 further including the step after step d) of:

d') further folding said folded part into a three layered edge.

16. The method of folding sheets of foil claimed in said knockdown roller further folding said folded part into a four layered edge.

17. The method of folding sheets of foil claimed in claim 14 wherein said folded part initially is preferably an upstanding vertical section.

18. The method of folding sheets of foil claimed in claim 17 wherein said folded part initially is preferably an upstanding vertical section connected to a downwardly disposed tail section forming an inverted V shape.

* * * * *